US007520370B2

(12) United States Patent
Gudim

(10) Patent No.: US 7,520,370 B2
(45) Date of Patent: Apr. 21, 2009

(54) COMBINATION ACOUSTIC DIFFUSER AND ABSORBER AND METHOD OF PRODUCTION THEREOF

(76) Inventor: William Orlin Gudim, 2121 Eagle Bluff Cir., Burnsville, MN (US) 55337

( * ) Notice: Subject to any disclaimer, the term of this patent is extended or adjusted under 35 U.S.C. 154(b) by 349 days.

(21) Appl. No.: 11/383,886

(22) Filed: May 17, 2006

(65) Prior Publication Data

US 2007/0267248 A1 Nov. 22, 2007

(51) Int. Cl.
*E04B 1/82* (2006.01)

(52) U.S. Cl. ..... 181/293; 181/284; 181/286; 181/290; 181/292

(58) Field of Classification Search ..... 181/293, 181/286, 284, 290, 292
See application file for complete search history.

(56) References Cited

U.S. PATENT DOCUMENTS

| | | | | | |
|---|---|---|---|---|---|
| 2,153,357 | A | | 4/1939 | Wente | |
| 2,779,429 | A | | 1/1957 | Mazer | |
| 2,887,173 | A | | 5/1959 | Boschi | |
| 3,103,255 | A | * | 9/1963 | Boschi et al. | 181/293 |
| 3,182,747 | A | | 5/1965 | Wilhelmi et al. | |
| 4,226,299 | A | * | 10/1980 | Hansen | 181/284 |
| 4,425,981 | A | | 1/1984 | Kiesewetter et al. | |
| 4,821,839 | A | | 4/1989 | D'Antonio et al. | |
| 4,971,850 | A | | 11/1990 | Kuan-Hong | |
| 5,027,920 | A | | 7/1991 | D'Antonio et al. | |
| 5,401,921 | A | * | 3/1995 | D'Antonio et al. | 181/286 |
| 5,587,564 | A | | 12/1996 | Stief et al. | |
| 5,665,943 | A | | 9/1997 | D'Antonio | |
| 5,692,347 | A | | 12/1997 | Hulek | |
| D398,710 | S | | 9/1998 | Gonzalez | |
| 5,969,301 | A | * | 10/1999 | Cullum et al. | 181/286 |
| 6,202,786 | B1 | | 3/2001 | Pfaffelhuber et al. | |
| 6,244,378 | B1 | * | 6/2001 | McGrath | 181/292 |
| 6,305,494 | B1 | | 10/2001 | Pfaffelhuber et al. | |
| 6,630,222 | B1 | | 10/2003 | Fay et al. | |
| 2001/0050197 | A1 | | 12/2001 | Wood | |
| 2002/0125067 | A1 | | 9/2002 | Porte et al. | |
| 2002/0134615 | A1 | | 9/2002 | Herreman et al. | |
| 2002/0134616 | A1 | | 9/2002 | Sheperd | |
| 2003/0006090 | A1 | | 1/2003 | Reed | |
| 2003/0006092 | A1 | * | 1/2003 | D'Antonio et al. | 181/293 |
| 2003/0062217 | A1 | * | 4/2003 | Sheng et al. | 181/290 |

* cited by examiner

*Primary Examiner*—Walter Benson
*Assistant Examiner*—Christina Russell
(74) *Attorney, Agent, or Firm*—Peter Papp

(57) ABSTRACT

The present invention relates to a combination acoustic diffuser and absorber and method of production thereof. The diffuser has an acoustically reflective surface that may be made by the vacuum forming of pliable sheet material in conformity with a shaped template and the subsequent fixing of the resulting shape of said material, and which surface includes a plurality of wells, the depths of which wells may be determined by number theory sequences. The absorber may include one or more tunable Helmholtz resonators which may be attached to the rear face of the diffusing surface. The combination acoustic diffuser and absorber may be optimized in its function and construction for use in a typical residential application. A kit may also be provided that comprises a diffuser, absorbers, mounting hardware, and assembly and adjustment instructions.

10 Claims, 11 Drawing Sheets

COMBINATION ACOUSTIC DIFFUSER AND ABSORBER AND METHOD OF PRODUCTION THEREOF

BRIEF SUMMARY OF THE INVENTION

The present invention relates to acoustical room treatments, and more specifically relates to combination acoustical diffusers and absorbers, and a method for the production thereof.

BACKGROUND OF INVENTION

The present invention relates to acoustical room treatments, and more specifically relates to combination acoustical diffusers and absorbers, a method for the production thereof, and kits for making the same.

Various criteria exist for assessing the quality of the sound heard by a listener listening to the acoustical broadcast into the listening environment of an amplified electronically-recorded acoustical signal. One of the most commonly employed of these criteria is that the originally recorded acoustical signal should be faithfully and accurately acoustically reproduced at the position of the listener. In order that this be achieved, the listening environment must not exhibit acoustical qualities that unduly mask, distort, or confuse the reception of the broadcast signal by the listener. Another of these criteria is that the aural quality of the sound heard by a listener should be subjectively pleasing to that listener. In order that this be achieved, the listening environment may exhibit acoustical qualities that mask, distort, confuse, or otherwise affect the reception by the listener of the broadcast signal in a subjectively pleasing fashion. In realizing these performance criteria, both diffusion and absorption of acoustical energy in a listening environment have well-established utilities.

Various general performance criteria exist for the diffusion characteristics of acoustical energy diffusing means; a comprehensive discussion of these general diffusion performance criteria is presented by D'Antonio and Cox, J. Audio Eng. Soc. vol 46, no. 12 pp 1081-1088. One particular diffusion performance criterion that has been articulated is the amplitude reduction of the specular reflection; another is the homogeneity in all diffusion directions of the intensity of the reflected acoustical energy. Various means of acoustical energy diffusion have been developed to meet these various general performance criteria.

One acoustical energy diffusion means is the shaped acoustically reflective surface which may consist of a plurality of planar surfaces, a curved surface, or some combination of these elements. A curved surface can be simple, for example based upon the arc of a circle, or can be complex, for example a surface with multiple and irregular corrugations. An appropriately shaped complex curved acoustically reflective surface can function as what is known in the art as a reflection phase grating. Various means have been developed to optimize the performance of shaped surface acoustic diffusers relative to the various established general diffusion performance criteria. One reflection phase grating performance optimization means is the use of number theory sequences to determine the shape of the surface. A number theory sequence used to achieve homogeneous reflected acoustical energy distribution in all diffusion directions is the quadratic residue sequence. It is felt that this homogeneous reflected energy distribution will minimize at the listening position any deviation from the acoustical energy distribution of the original signal. A number theory sequence used to reduce the amplitude of the specular reflection is the primitive root sequence. It is felt that the amplitude reduction of the specular reflection between parallel opposing walls will reduce at the listening position the phenomenon known in the art as slap echo. Also, it is felt that the amplitude reduction of early specular reflections from a ceiling produces an effect that is subjectively pleasing to most listeners. It has been shown by Schroeder (J. Audio Eng. Soc., Vol. 32, No. 4, 1984 April) that most listeners prefer listening environments that do not produce strong interaural similarity at the position of the listener. Since the dissimilarity between signals at the two ears is increased with the increasing strength of laterally traveling sound, listener preference associated with the widths of acoustical environments was also investigated, and it was found that most listeners prefer listening environments that are narrower rather than wider (Schroeder, J. Audio Eng. Soc., Vol. 32, No. 4, 1984 April). Since the strength of the laterally travelling sound can be increased by increasing the strength of short-delay reflections from the sidewalls of a listening environment (a correlation exceeding 90% between interaural cross correlation and mean width of listening environment was shown by Bradley, J. Acoust. Soc. Am., Vol. 73, 1983 June), it was concluded that listeners prefer listening environments exhibiting strong short-delay sidewall reflections over those exhibiting weak short-delay sidewall reflections. Since the presence of strong short-delay non-lateral sound, such as that reflected from a low, planar, acoustically reflective ceiling that produces reflections arriving at a listeners' two ears with nearly equal amplitudes and very nearly in phase, tends to produce strong interaural similarity, it is concluded by Schroeder that most listeners will prefer listening environments that do not exhibit strong short-delay reflections from such a ceiling. To simultaneously reduce the strength of the undesirable short-delay ceiling reflections and increase the strength of the desirable short-delay sidewall reflections while preserving the total amount of acoustical energy within the listening environment, it is suggested by Schroeder that sound reflected from the ceiling be redirected into broad lateral patterns. An acoustical diffuser that acts as a reflection phase grating and that has its surface topology optimized through the use of a primitive root series is particularly effective at such sound redirection, as it can reduce greatly the strength of the specular reflection when mounted upon a ceiling, and directs sound reflections to the sides, and is thereby able to produce an effect demonstrated to be subjectively pleasing to listeners when it is mounted upon a ceiling (Schroeder, Phys. Today, vol. 33, pp. 24-30 (1980 October)). A notable drawback of many existing reflection phase grating diffusers is that they are constructed from discrete pieces joined to each other, which construction method requires the sealing of these joints to ensure that sound does not "leak" out of the wells, which effect can result in the absorption of the leaked acoustic energy and therefore degrade the diffusion performance of the diffuser. Assembly of discrete pieces and subsequent sealing of the resulting assembly are expensive processes, and a diffuser having a monolithic acoustically reflective diffusing surface is therefore desired. The term "monolithic" as used herein is defined as "constructed such that there are no seams, gaps, or other discontinuities in the incomplete acoustically reflective diffusing surface that must be either sealed, filled, spanned, joined, or smoothed prior to the completion thereof".

Various general performance criteria exist for also the absorption characteristics of acoustical absorption means, which criteria are often referred to, or dictated by, the particular listening environment in which the absorber is to be employed. In turn, various means of acoustical absorption have been developed to meet these various general performance criteria. One such absorption means is the panel absorber, and another such absorption means is the Helmholtz resonator. Absorbers described in the literature also include those that combine panel and Helmholtz absorbers in a single unit. Various means have been developed to optimize the absorption performance of Helmholtz resonator absorbers relative to established absorption performance criteria. The acoustical absorption characteristics of a rigid-walled Helmholtz resonator absorber, including the center frequency of absorption, the magnitude of absorption at that center frequency, the absorption bandpass, and the absorption quality factor, may be selected to satisfy the identified performance criteria by the appropriate selection of cavity volume, orifice volume, and sound-absorbing materials contained within the cavity volume.

Acoustical devices combining acoustical diffusers and absorbers are described in the literature. Combination diffusers and absorbers include reflection phase grating diffusers combined with Helmholtz resonator absorbers. Helmholtz resonator absorbers found in the literature and in the field in combination with reflection phase grating diffusers take the form of distributed fixed-size perforation of the otherwise acoustically reflective diffuser surface, along with the containment of one or more sealed cavity or cavities behind the perforated surface, which cavity or cavities communicate(s) with the listening environment via only said perforations. A drawback of this approach is that the absorption characteristics of the Helmholtz resonator absorbers are not adjustable by a user thereof. Another drawback of this approach is that the efficiency of the otherwise reflective diffusing surface can decrease as it is perforated and thus has its reflective surface area reduced.

When an acoustical device is intended to be employed in a typical residential listening environment, design constraints and performance goals additional to the general absorption and diffusion criteria will be imposed upon that device by those characteristics common to such environments, such as physical dimensions, physical configuration, physical construction, health and safety concerns, and the private character of the space.

The finite physical dimensions common to many typical residential environments will place an upper limit on the physical dimensions of a rigid device so that the area of the device does not exceed the area of its intended mounting surface, so that the device is able to be transported into the environment from outside the environment, and so that the device can be moved about within the environment. Each component of the device must therefore be restricted in size to those dimensions that permit any component to be moved through a standard interior doorway of thirty inches width and eighty inches height, as well as to be negotiated around a ninety degree corner and through said standard interior doorway from a standard interior corridor of thirty-six inches width and ninety-six inches height.

The private character of the typical residential environment, and the maintenance of that private character, require a minimum of intrusion into that environment by persons other than occupants thereof and their personal invitees. Any device intended for use in the residential environment should therefore not be manufactured on-site, should be able to be transported into that environment by the occupant, and because as a class the general population can be characterized as technical laypersons, the device should be able to be installed, adjusted, and maintained by the layperson. Any such device should therefore be capable of off-site manufacture, should keep the number of individual components to a minimum, and should keep either its overall mass, if intended to be installed as a complete assembly, or the mass of any one of its components, if intended to be installed as complementary components, sufficiently low that either the entire assembly or any individual component thereof can be easily moved about and held in place by a person of ordinary strength. Also, the installation process should be as simple as possible and use only those tools likely to be found in a residential environment and should use readily available installation hardware in the event of loss of, or damage to, the supplied hardware by the layperson, or in the event that the device is moved and the original mounting hardware is not easily retrievable or re-usable. Because the absorption performance of the device will vary according to its installation location, the acoustical absorption performance characteristics of the device should be able to be adjusted by the layperson at any time before, during, and after installation of the device. Absorbing components of a combination acoustical diffuser and absorber should therefore be made adjustable, and the adjustment means should remain accessible at all times to permit adjustment after installation.

Health- and safety-related requirements are also imposed by the typical residential environment upon any device intended for use therein. As residential environments are often occupied, and may contain children, the device should not introduce or require introduction into that environment of any substances that with repeated long-term exposure may be deleterious to human health. The device should therefore be able to be made of materials that resist decomposition a normal residential environment, that if they do decompose over time minimize the production of dust, debris, and odor, and that minimize off-gassing into that environment of substances resulting from the manufacture, installation, or decomposition of the device. Also, the device should employ materials that are not likely to pose a safety risk if damaged, such as does ordinary glass when shattered, and the device should be of low mass to minimize the danger of resulting damage should it dislodge from its mounting surface. Additionally, the device should employ materials that are able to withstand cleaning, and that can be manufactured into a configuration that is not difficult to clean, especially having minimal inside corners and having a smooth surface.

The light-duty construction methods and materials employed in the building of the typical residential environment impose particular design constraints upon devices intended for attachment thereto. In particular, the interior walls and ceilings of such environments are often composed of either sheetrock over wooden frame construction, or a plaster over lath construction. Further, the ceilings may be covered by acoustic tiles such as in a dropped ceiling installation. The mass of any device to be affixed to such surfaces should therefore be minimized in order that the device be capable of direct mounting to a surface constructed from a material as weak as sheetrock or acoustical tile without necessitating the structural reinforcement of said surfaces as by, for example, the use of backing plates, and in order that the device remain securely and indefinitely supported by such a surface either vertically, as when mounted to a wall, or horizontally, as when mounted to a ceiling.

The particular physical configuration of the typical residential environment also imposes performance requirements upon an acoustical device intended to be used therein. The acoustically significant characteristics that are common to many residential environments are the existence of an acoustically reflective floor, an acoustically reflective ceiling, the fact that the reflective floor and reflective ceiling are both planar, the fact that the reflective planar floor is parallel to the reflective planar ceiling, and the fact that the distance between the reflective planar floor and the parallel reflective planar ceiling is most often close to 96 inches. These physical conditions permit the formation of standing waves within the listening environment at the frequency having a wavelength equal to 96 inches (fundamental), corresponding to approximately 70 Hz, and at frequencies that are positive integer multiples of that fundamental frequency (harmonics). These standing waves will encourage the creation of acoustic pressure gradients along the vertical axis of the listening environment at these frequencies, the particular acoustic pressure gradient profile being dependent upon the particular frequency. The local magnitude of the acoustic pressure can pose a problem if it contributes to a perceived excess of sound energy of a particular frequency at the position of the listener, relative to the contribution of that frequency to the overall source program. A small number of preferred listener positions can be determined for the typical residential environment, as the listener is overwhelmingly often in a small number of positions while listening: standing, sitting at a table or desk, or sitting in an easy chair, sofa, or occasional chair. Although there is some variability in these positions, it may be safely concluded that for average adult listeners they correspond with listener head heights of approximately 65, 48, and 40 inches. In turn, it may be safely concluded that a listener's head is rarely within 30 inches of either the floor or the ceiling, and thus almost always within the middle third of the distance from the floor to the 96-inch-high ceiling, or from 0.33 to 0.66 fractional room height, and often at the exact middle of the room height, or 0.50 fractional room height. Any acoustical device intended for use in a typical residential environment should therefore address acoustical phenomena likely to arise or to be noticed within the middle vertical third of the room, and especially at 0.50 fractional room height. From measurements of acoustic pressures along the vertical room axis, it is known that sound traveling in the vertical direction will contribute no acoustic energy at 0.50 fractional room height at the fundamental and even harmonics thereof, but will contribute a maximum amount of acoustic energy at this same position at odd harmonics of the fundamental. This situation will contribute to the perception of an excess of acoustic energy at the odd harmonics at 0.50 fractional room height, which is an unacceptable result as judged by the articulated performance criterion of faithful and accurate acoustical reproduction within the listening room of the source signal. This unacceptable result is exacerbated by the fact that distortion products formed when reproduction of the fundamental tone is attempted often appear as acoustic energy at odd-order harmonics of that fundamental. Through the mechanism described above, these distortion products become most noticeable exactly where listeners are usually located, and where the acoustic energy of the desired fundamental tone is at a minimum. This undesirable difference between the acoustic energy levels at the fundamental frequency and odd-order harmonic frequencies cannot be remediated by the addition into the room of more energy at the fundamental frequency, because for all other things being equal, the physical phenomena characteristic of the room that produce the relative energy density distributions of the fundamental and all harmonics thereof are independent of the absolute amount of the acoustic energy at typical listening levels below 120 decibels introduced into the room at the fundamental frequency. Further, it is difficult to remediate this undesirable difference between the acoustic energy levels at the fundamental frequency and odd-order harmonic frequencies by changing listening position, as it is often not possible or practical for a listener to change position along the vertical axis of the room, unlike along the two horizontal axes of the room, in order to receive an acoustical energy density distribution that more accurately reflects that energy distribution in the original source. Therefore, an acoustical device intended to be used in a typical residential environment should absorb sound energy at the odd-order harmonic frequencies of roughly 140 Hz, 280 Hz, 420 Hz, 560 Hz, etc. Further, the diffusion characteristic of any acoustical device intended to be used in the typical residential environment should ensure that diffusion of sound exists, or that the effects of the diffusion are noticed, within the middle vertical third of the room. Further yet, because typical residential listening environments tend to have low ceiling heights of approximately 96 inches, without further acoustic treatment there will tend to be strong early reflections from both ceiling and floor. Because research already discussed suggests that strong early ceiling and floor reflections do not contribute to subjectively pleasing sound, and in fact may detract from it, these early reflections from both floor and ceiling should be suppressed. Many typical residential environments have acoustically absorbent materials on the floor in the form of carpeting or rugs. While a certain amount of sound absorption in a listening environment can be desirable, notably to reduce the sound energy level at particular positions within the room at which they may be elevated due to room configuration, absorption reduces the total amount of acoustic energy within the listening environment, a phenomenon which may have its own undesirable effects. As a result, an acoustical device intended for use in residential environments that does not reduce the amount of acoustic energy within a listening environment is desired for suppressing early reflections from a residential ceiling.

In addition to the general diffusion and absorption performance criteria and the particular design constraints and performance goals imposed by the typical residential environment, it is specified that the device should be cost-effective to manufacture, transport, and store.

To manufacture the device in a cost-effective manner, it is specified that the material used in the fabrication of the device must be inexpensive and must be readily available. It is also specified that any hardware used in the assembly and mounting of the device should be inexpensive and readily available. An attachment means that permits the use of any standard technique for mounting items directly to sheetrock, which techniques are well known, should therefore be employed. It is further specified that the device must be produced by an efficient process. This criterion requires the use of a process that minimizes the production of waste products, that uses a materially efficient manufacturing process that minimizes the use of disposable products, that minimizes specialized tooling required, that allows production of a monolithic reflecting surface, and that can be used to produce similarly-performing devices of varying physical configurations. It is also specified that the manufacturing process must allow the working of a material that is durable, lightweight, and readily available in many locations.

To permit the device to be transported in a cost-effective manner, the device must be made of an appropriate material in an appropriate configuration. The chosen material must therefore be of low mass, and the configuration chosen should allow multiple units to be packed efficiently, which in the case of a rigid reflecting surface necessitates the design of nestable reflecting surfaces and a knock-down capability that allows the device to be shipped disassembled to permit the unencumbered nesting of said rigid reflecting surfaces. Since multiple reflecting surfaces must be nestable, and since each reflecting surface will have the same irregular surface topology, that surface topology should be one where the walls of the contemplated wells are not oriented at right angles to the area of the diffuser, as this would not permit the nesting of multiple identical reflecting surfaces. Further, the thickness of the reflecting surface should be practically minimized, in order to minimize any difference between the radii of curvature of the front and the rear faces of the surface, to ensure effective nesting of multiple surfaces.

To permit the device to be stored in a cost-effective manner, the device must be made of an appropriate material in an appropriate configuration. The material used must therefore resist degradation in a normal environment. Further, the configuration of the device should allow efficient packing, which when a rigid reflecting surface is used necessitates a knock-down construction with nestable reflecting surfaces.

Specifically desired therefore is a combination acoustical diffuser and absorber that employs a shaped un-perforated monolithic acoustically reflective surface acting as an acoustic diffuser that is sufficiently rigid so as not to require support around its perimeter in order to maintain its shape, that uses Helmholtz resonators as absorbers, that permits easy user adjustment of the Helmholtz resonator absorption characteristics both before and after installation, that uses existing techniques for mounting to sheetrock with readily-available hardware, that allows use of the diffuser with or without the absorbers, that is made from materials that are inexpensive, readily-available, non-toxic, that resist deterioration in the typical residential environment, that are unlikely to pose a safety risk if damaged and that are capable of being cleaned, that is capable of being optimized to absorb acoustic energy at 140, 280, 420, and 560 Hz, that can be manufactured off-site, that permits releasable attachment of the Helmholtz resonators to the reflecting surface, that permits the nesting of multiple reflecting surfaces for storage and transport, that permits the edge-to-edge butting of two or more individual reflecting surfaces to produce a larger resultant contiguous reflecting surface, that has no one component exceeding either those dimensions that would permit it to pass from a standard interior corridor through a standard interior doorway or that mass that can be easily lifted by a person of ordinary strength, that requires at most a screwdriver, a pliers, a pencil and a hammer for installation, that is of sufficiently low installed mass that it can be securely and indefinitely mounted to sheetrock or ceiling tile without any structural reinforcement thereof, and that permits the shaping of the diffusing surface into corrugations, the shape of which corrugations can be determined in accordance with quadratic residue or primitive root sequences. Desired also is a kit for a combination acoustical diffuser and absorber optimized for use in the residential environment that contains all parts of the diffuser and absorber, mounting means and hardware, and detailed instructions that include both chart and graphical representations of the function and adjustment of the device.

DETAILED DESCRIPTION OF INVENTION

Figure 1:
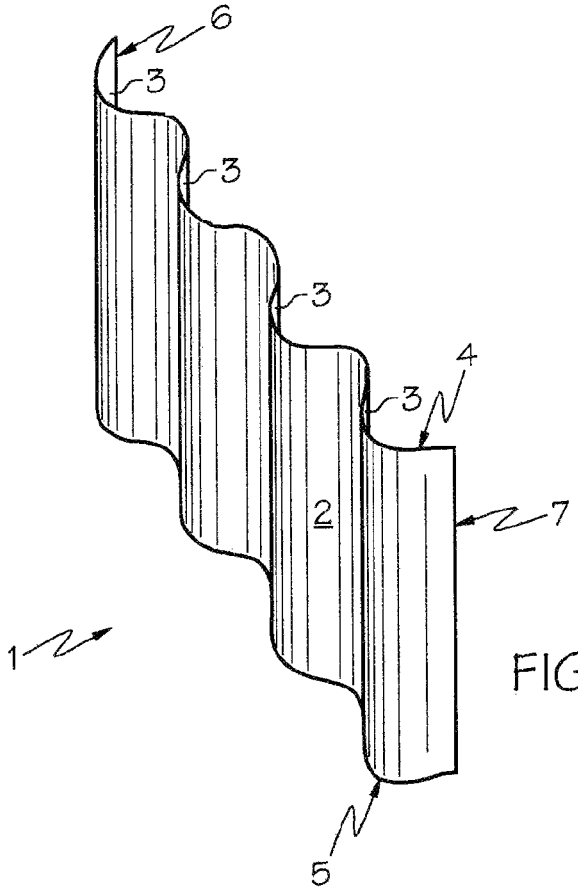
FIG. 1 is an elevated perspective view of a corrugated wooden curved acoustically reflective surface.
Figure 2:
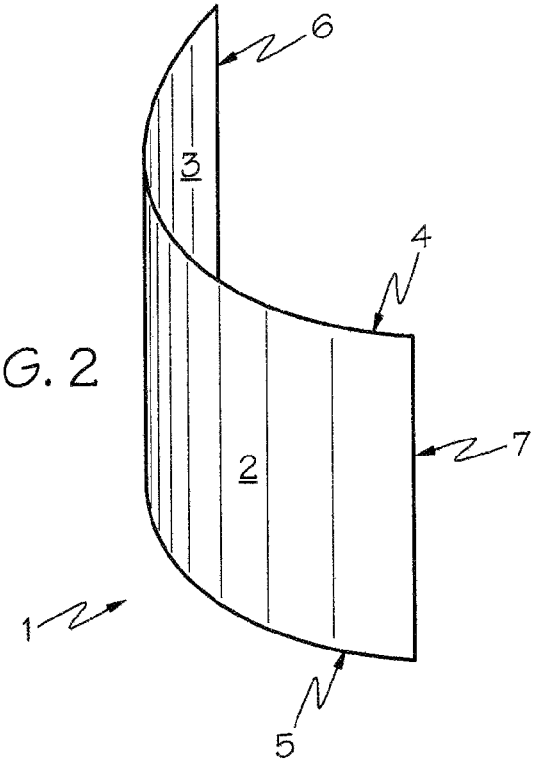
FIG. 2 is an elevated perspective view of a wooden curved acoustically reflective surface, the curvature of which describes an arc of a circle.
Figure 3:
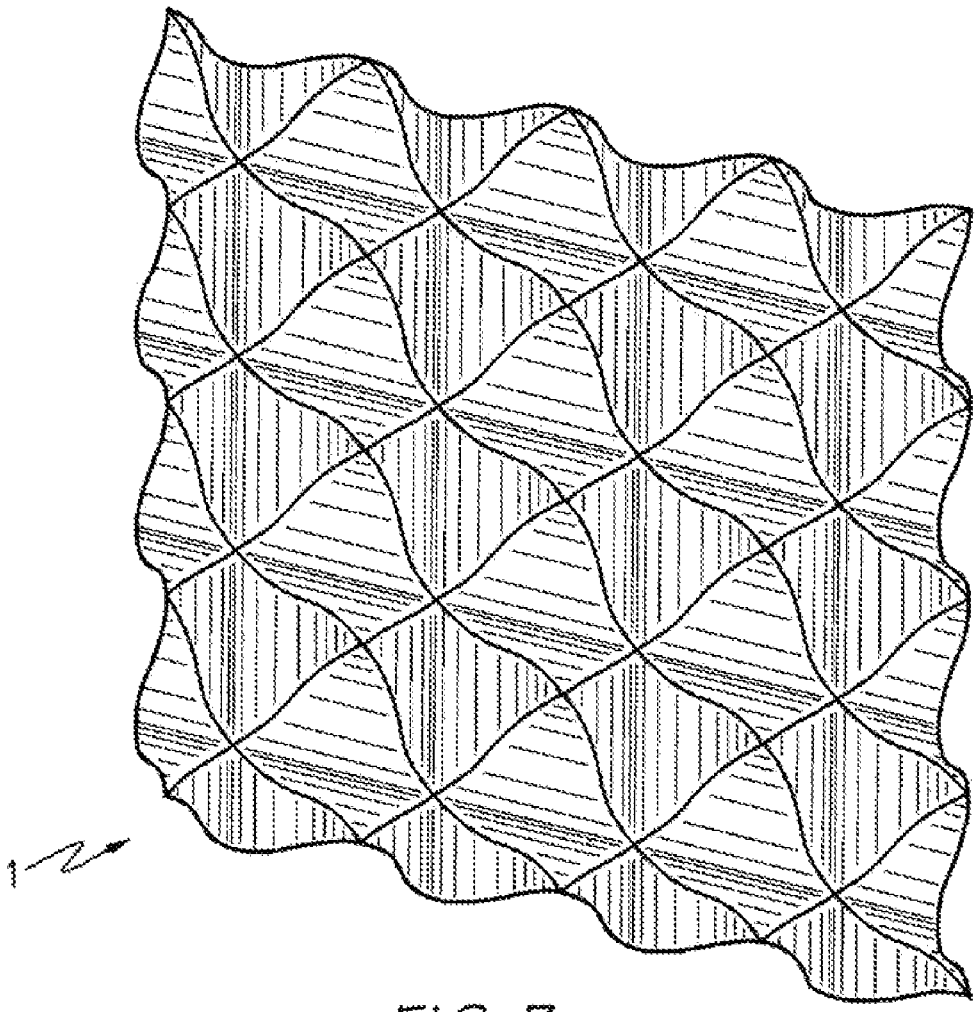
FIG. 3 is an elevated perspective view of a wooden dimpled acoustically reflective surface.
Figure 4:
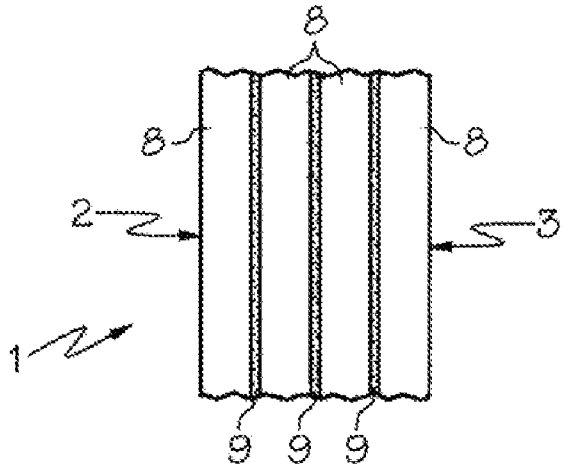
FIG. 4 is an elevational view of any of the edges 4, 5, 6, or 7 of any of FIG. 1, 2, or 3.
Figure 5:
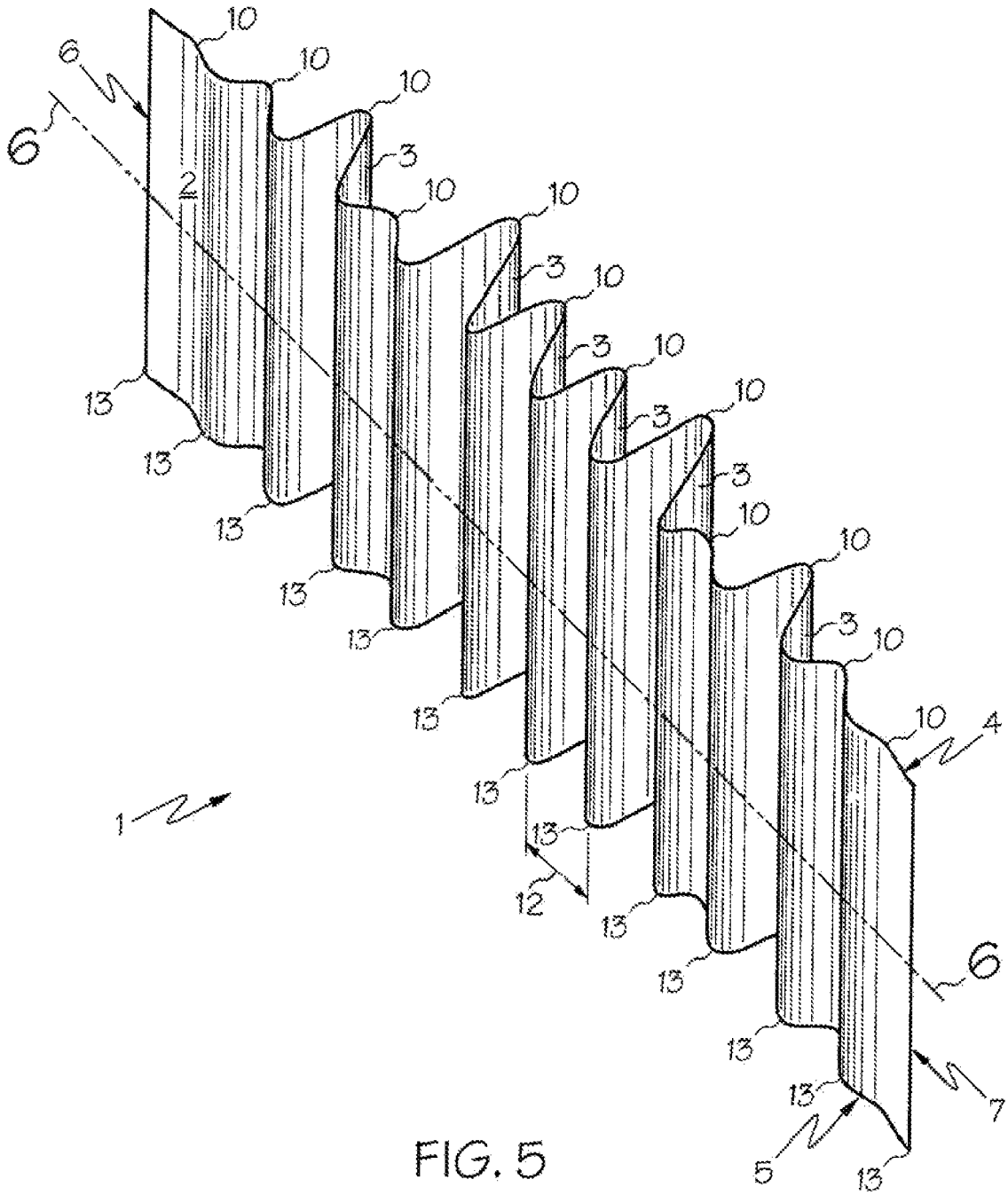
FIG. 5 is an elevated perspective view of a corrugated wooden curved acoustically reflective surface, in which the depths of successive wells are determined by the calculation of a quadratic residue sequence.
Figure 6:
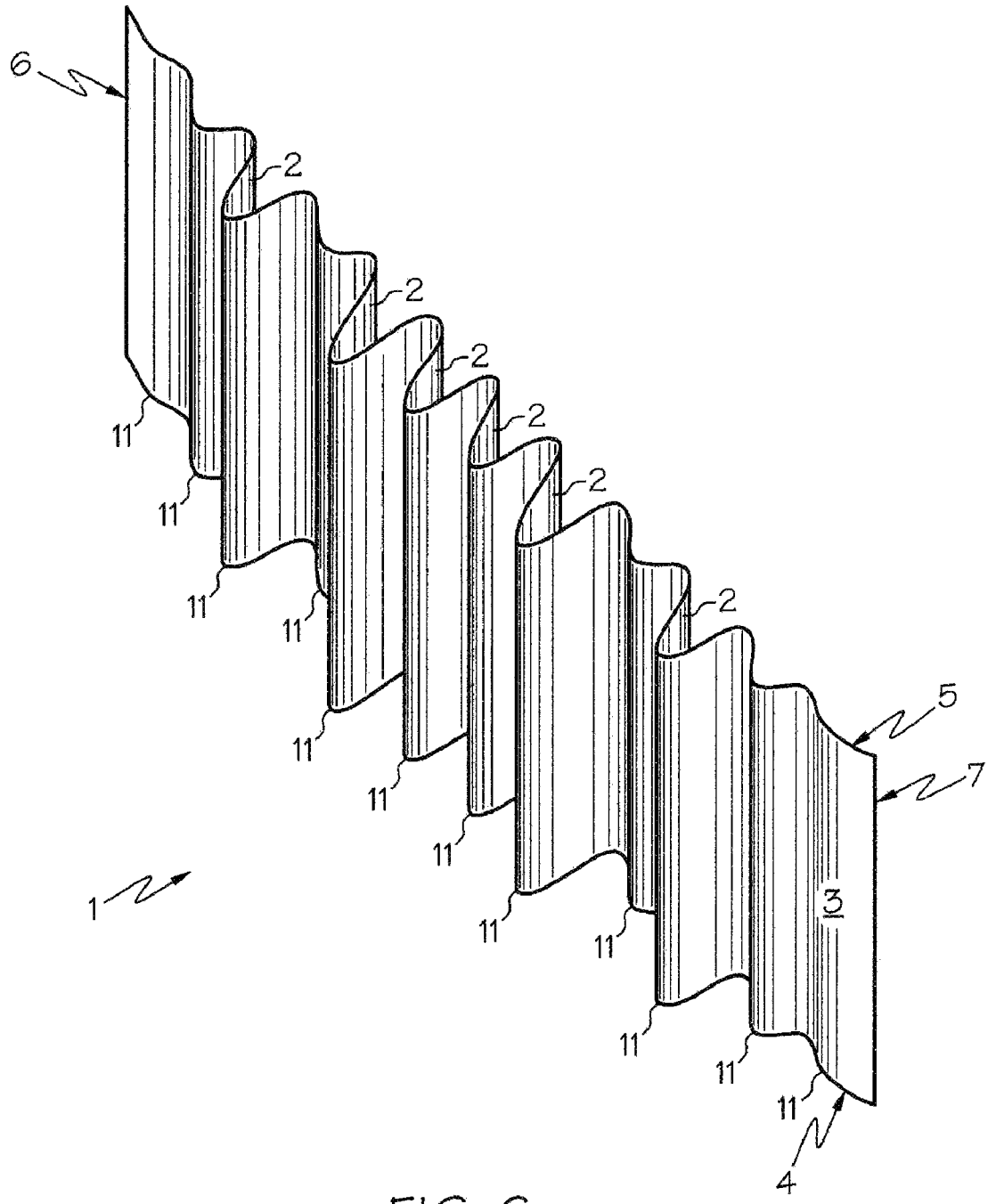
FIG. 6 is an elevated perspective view of the corrugated wooden curved acoustically reflective surface depicted in FIG. 5, rotated 180 degrees about the line 6-6 in FIG. 5.
Figure 7:
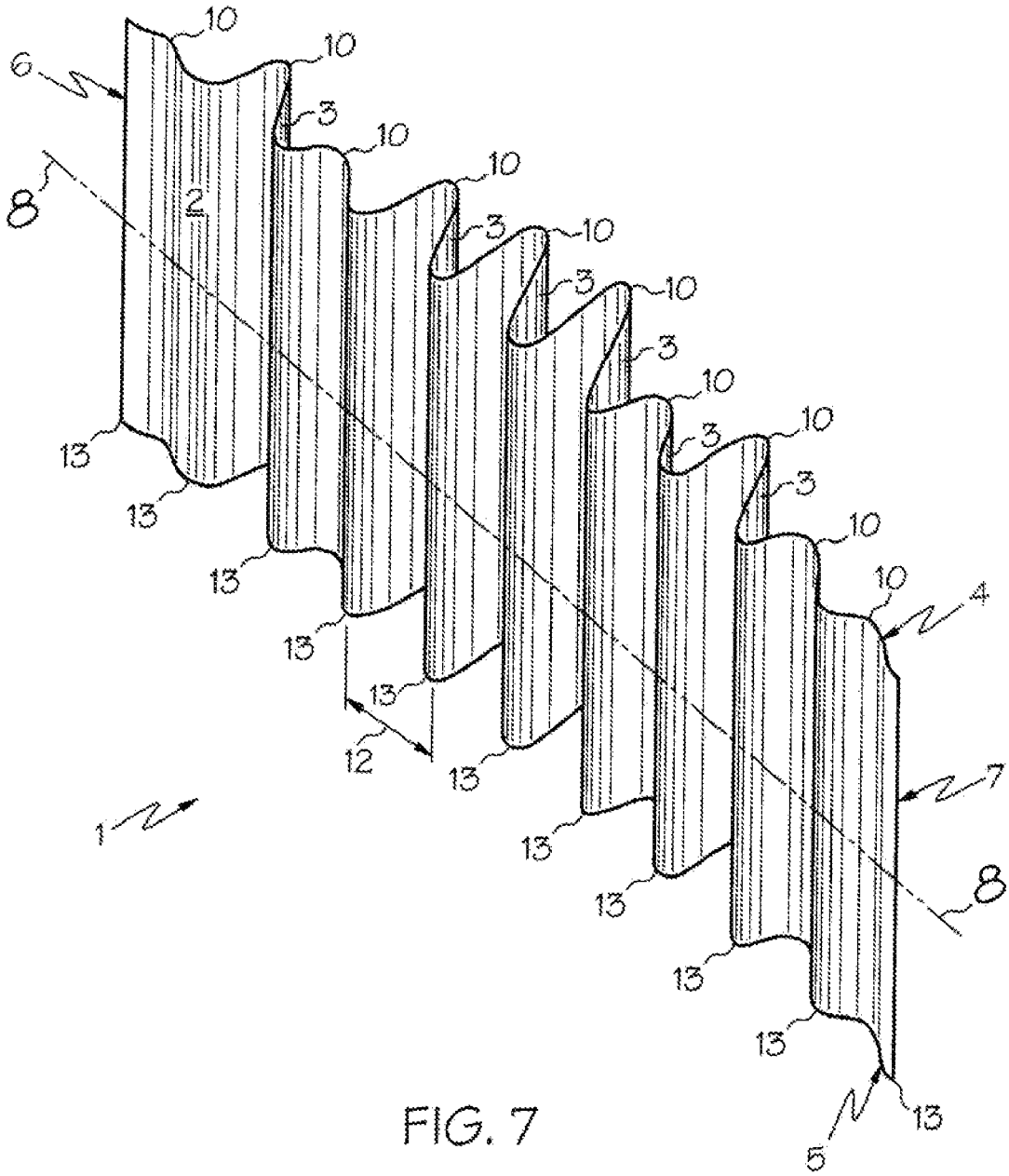
FIG. 7 is an elevated perspective view of a corrugated wooden curved acoustically reflective surface, in which the depths of successive wells are determined by the calculation of a primitive root sequence.
Figure 8:
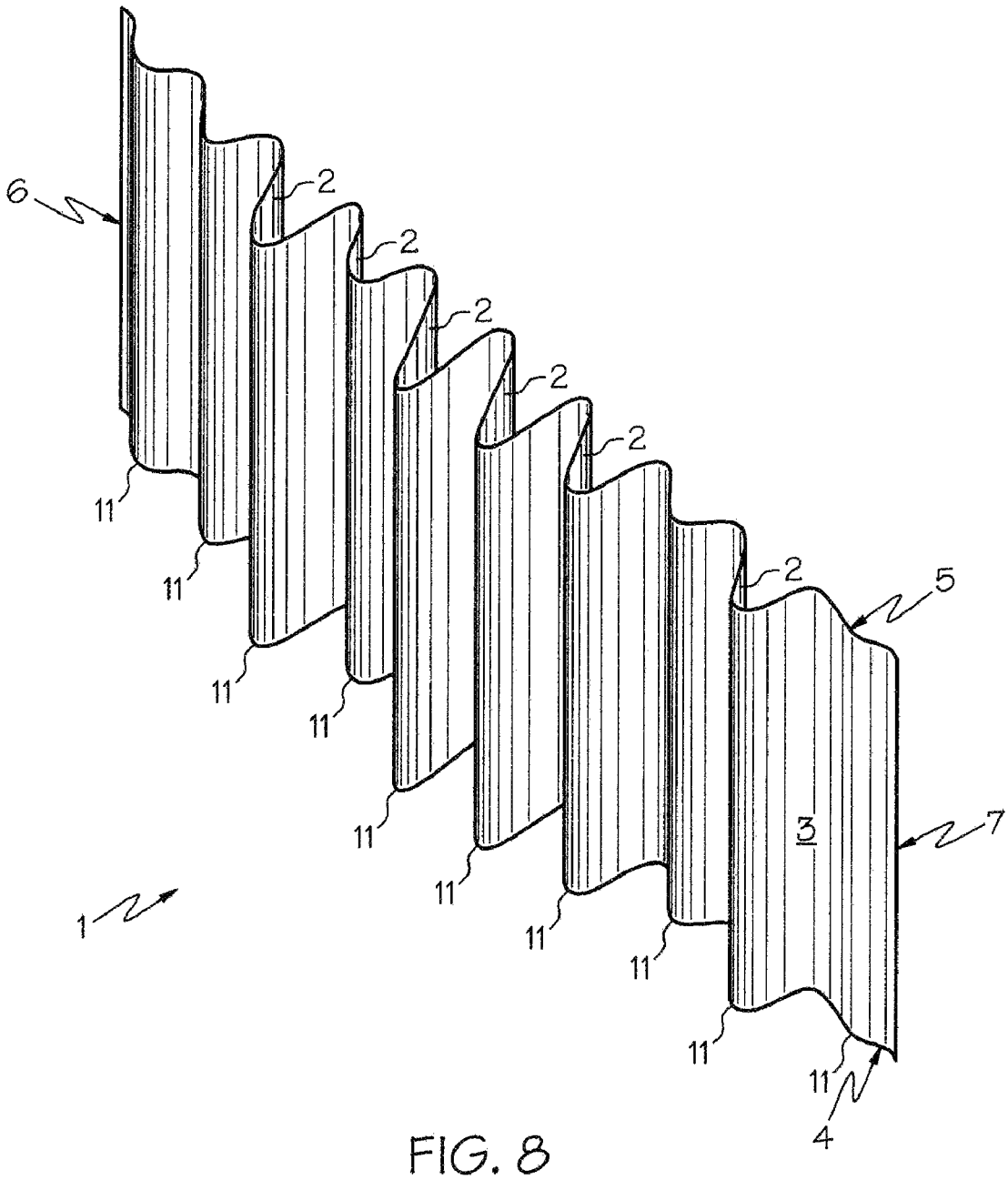
FIG. 8 is an elevated perspective view of the corrugated wooden curved acoustically reflective surface depicted in FIG. 7, rotated 180 degrees about the line 8-8 in FIG. 7.
Figure 9:
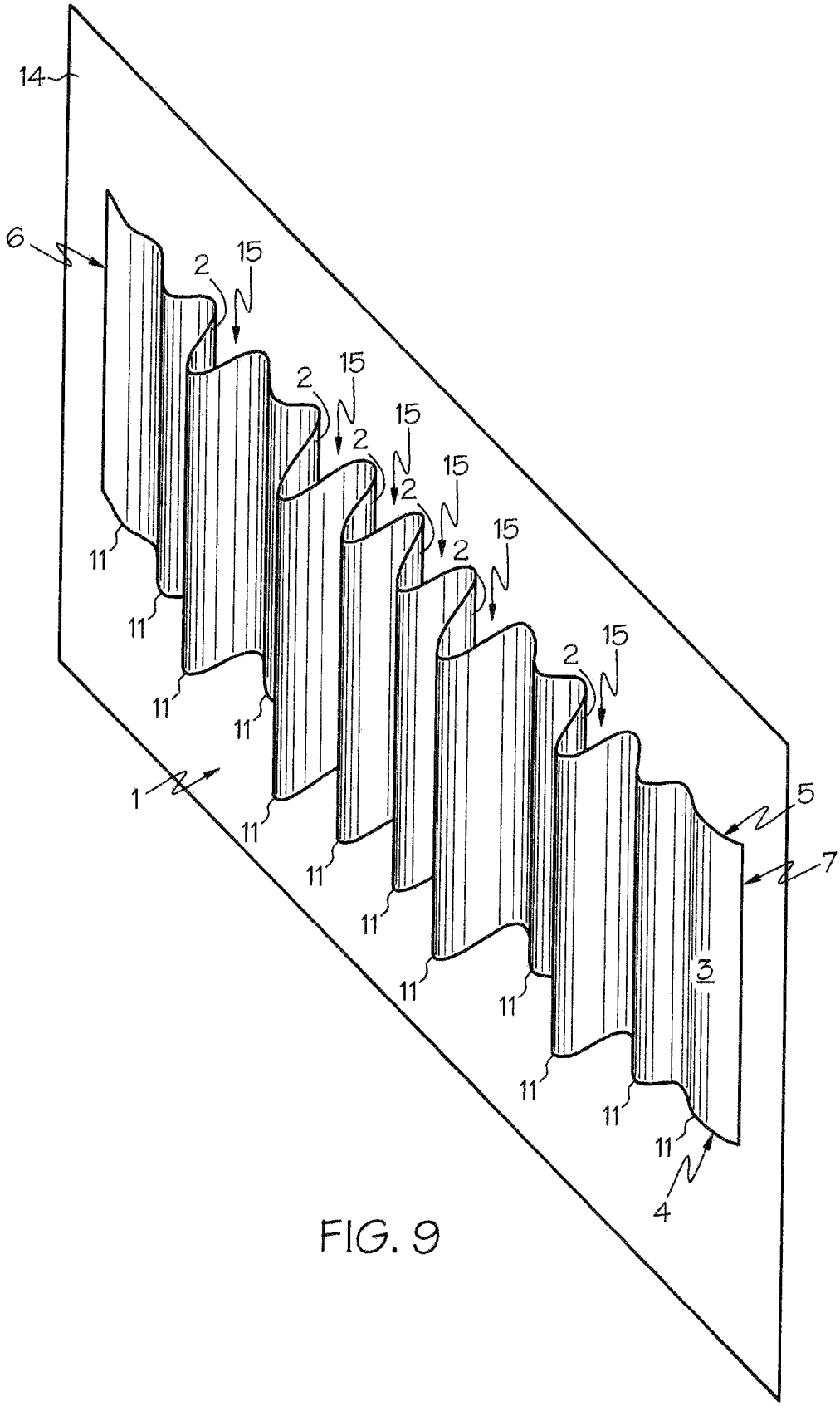
FIG. 9 is an elevated perspective view of the corrugated wooden curved acoustically reflective surface depicted in FIG. 6, with its rear surface abutting a planar surface.
Figure 10:
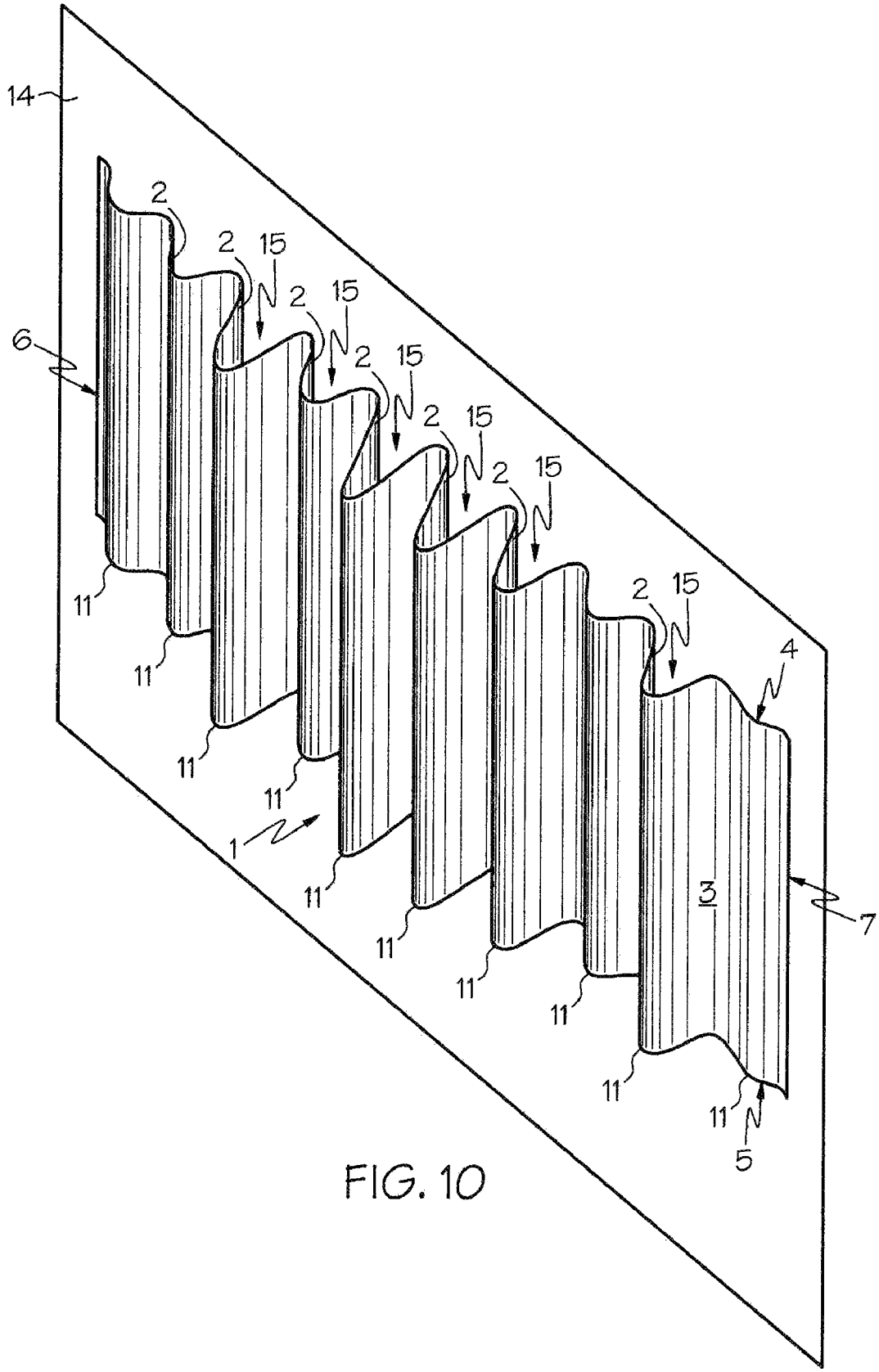
FIG. 10 is an elevated perspective view of the corrugated wooden curved acoustically reflective surface depicted in FIG. 8, with its rear surface abutting a planar surface.
Figure 11:
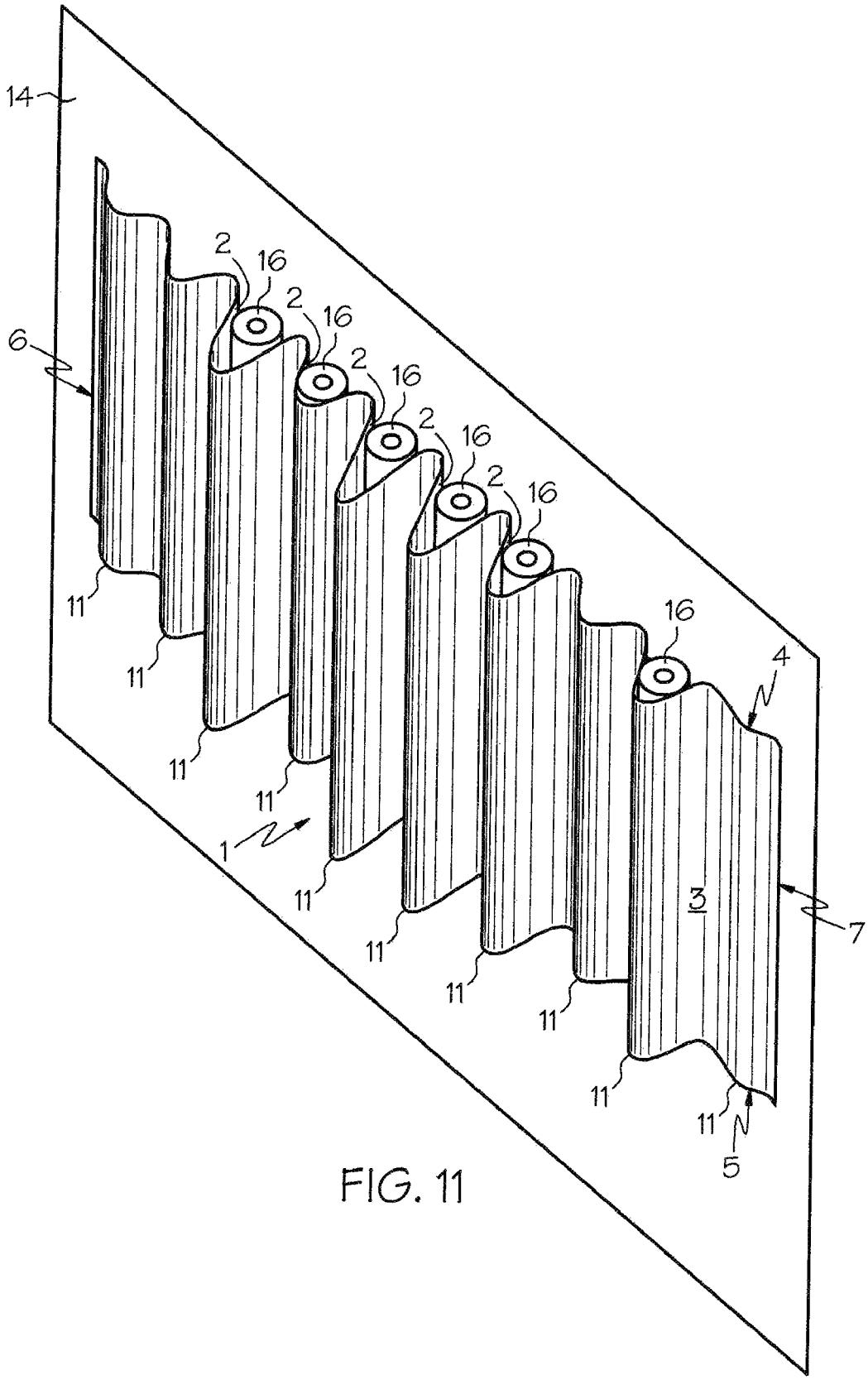
FIG. 11 is an elevated perspective view of the corrugated wooden curved acoustically reflective surface and abutting planar surface depicted in FIG. 10, with the cavities formed between the two surfaces housing Helmholtz resonator absorbers.
Figure 12:
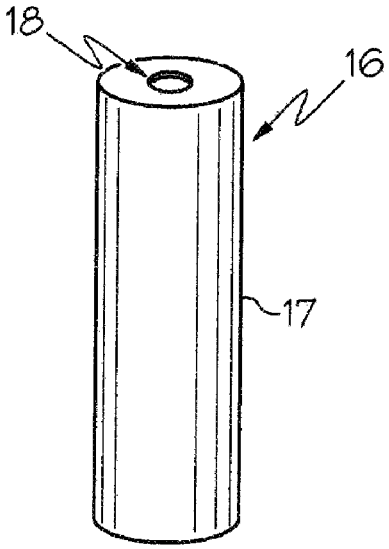
FIG. 12 is an elevated perspective view of an embodiment of a Helmholtz resonator absorber.

Referring now to the drawings, and particularly to FIG. 1 thereof, an embodiment of a curved acoustically reflective diffusing surface 1 is shown, constructed from wood. The curved diffusing surface 1 has a front face 2, a rear face 3, a top edge 4, a bottom edge 5, a left edge 6 and a right edge 7. The topology of the curved diffusing surface 1 can be corrugated as depicted in FIG. 1, or can be based on a single continuous curve such as the arc of a circle, as depicted in FIG. 2, both of which implementations will diffuse the acoustic energy incident upon the surface in a horizontal hemidisk extending the height of the diffusing surface, or more generally as is known in the art, "one-dimensionally". The overall height of the curved acoustically reflective diffusing surface 1 in FIGS. 1 and 2 is optimally 32 inches, which height permits the hemidisk of diffusion to occupy the middle vertical third of a 96-inch-high listening environment when the diffusing surface 1 is mounted vertically-centered within that environment. Alternatively, the curved diffusing surface could have a dimpled topology as depicted in FIG. 3, which implementation will diffuse acoustic energy incident upon the surface in a hemispherical pattern, or more generally as is known in the art, "two-dimensionally". The contouring of the surface contributes to its rigidity and can allow the surface to maintain its shape without requiring support around its perimeter. Although the embodiment depicted in FIG. 3 illustrates a surface topology having discontinuities in its curvature, referring to the four corners in the rise of each dimple, the surface could equally well be one of continuous curvature, with smooth curves throughout and no corners in the rise of any dimple. FIG. 4 depicts the internal structure of the curved acoustically reflective diffusing surface 1 as would be seen along any of the edges 4, 5, 6, or 7. As shown in FIG. 4, the wooden curved diffusing surface 1 is comprised of a plurality of adjacent sheets of wood veneer 8, wherein each sheet is bonded to neighboring sheets of wood veneer using adhesive 9. Four individual sheets of wood veneer 8 are shown in FIG. 4, but any number of sheets, including one, may be used to achieve those physical properties, including durability, rigidity, mass, and thickness, desired of the diffusing surface 1. Alternatively, one or more sheets of wood veneer 8 may be bonded to a material other than wood veneer such as woven or non-woven fabric that has the ability to enhance the structural integrity of the wood veneer 8 while remaining of comparable or lesser thickness. Such composite structures can be successfully constructed using a vacuum forming technique that permits thin and pliable starting materials such as wood veneer and cloth to be shaped in conformity with a range of desired template shapes into a final structure having physical properties different from those of the individual component materials. Such vacuum-forming techniques are conventional, and include the placement of the template and workpiece into a sealed bag from which air is evacuated, allowing atmospheric pressure to be applied at all points of the workpiece to bring it into contact with the template, with other workpieces, or both. The use of multiple sheet-stock workpieces with intervening layers of adhesive allow the production of a sandwich-type structure. Shown in FIG. 5 is a one-dimensional wooden curved acoustically reflective diffusing surface 1, the surface shape of which is characterized by a series of parallel wells 10 extending the full height of the curved acoustically reflective diffusing surface 1, the successive depths of which wells 10 are determined by the calculation of a quadratic residue sequence. Shown in FIG. 6 is the diffusing surface 1 of FIG. 5 rotated 180 degrees about the axis 6-6 shown in FIG. 5 such that the wells 10 of FIG. 5 are now the crests 11 of FIG. 6, and such that the front face 2 of the diffusing surface 1 of FIG. 5 is now the rear face 2 of the diffusing surface 1 of FIG. 6. Similarly, shown in FIG. 7 is a one-dimensional wooden curved acoustically reflective diffusing surface 1 having its surface shape characterized by a series of parallel wells 10 extending the full height of the curved acoustically reflective diffusing surface 1, the successive depths of which wells 10 are determined by the calculation of a primitive root sequence, and shown in FIG. 8 is the diffusing surface of FIG. 7 rotated 180 degrees about the axis 8-8 shown in FIG. 7 such that the wells 10 of FIG. 7 are now the crests 11 of FIG. 8 and such that the front face 2 of the diffusing surface 1 of FIG. 7 is now the rear face 2 of the diffusing surface 1 of FIG. 8. In a preferred embodiment of a curved acoustically reflective diffusing surface, the curved acoustically reflective diffusing surface has a surface shape that permits the nesting of one curved acoustically reflective diffusing surface into another identically shaped curved acoustically reflective diffusing surface such that the front face 2 of the first curved acoustically reflective diffusing surface is in substantially continuous contact with the rear face 3 of the second curved acoustically reflective diffusing surface; this configuration permits the stacking of a plurality of curved acoustically reflective diffusing surfaces into a minimum volume. It is recognized that when a curved acoustically reflective diffusing surface is employed, because the material used to make the curved acoustically reflective diffusing surface has a certain thickness, the radius of curvature of the outside of either a well or a crest will differ from the radius of curvature of the inside of that same well or crest by an amount equal to the thickness of said material, and that when two of said surfaces are stacked, continuous contact of the entire front face 2 of the first curved acoustically reflective diffusing surface with the rear face 3 of the second curved acoustically reflective diffusing surface is not possible without deformation of one or both of the first and second curved acoustically reflective diffusing surfaces. Such deformation can be minimized by use of a maximally thin material, and stacking efficiency can be maintained by use of a material that has sufficient elasticity to recover its original shape after deformation. A practical stacking limit will be reached and will depend on such factors as the material thickness, the material mechanical properties, and the original shape of the curved acoustically reflective diffusing surface. The diffusing surface 1 of both FIGS. 5 and 7 constitute a linear periodic grouping of an array of wells 10 of equal widths 12 but different depths, with the boundaries 13 of the wells being coplanar. Because of this coplanar characteristic, a continuous smooth curve will be formed when said left edge 6 or said right edge 7 of said diffusing surface 1 of both FIGS. 5 and 7 is butted up against a left edge 6 or right edge 7 of another adjacent diffusing surface 1, allowing the production of a large, smoothly continuous diffusing area built up from multiple adjacent individual diffusing surfaces 1. Also because the well boundaries are coplanar, if the rear face 2 of the diffusing surface 1 of either FIG. 6 or FIG. 8 abuts a planar surface 14 such as a ceiling or wall as shown in FIGS. 9 and 10, accessible cavities 15 are created between the rear face 2 of the curved diffuser 1 and the adjacent planar surface 14. These accessible cavities 15 are used to advantage to house Helmholtz resonators 16, as depicted in FIG. 11, which Helmholtz resonators are attached to the rear face 2 of the curved diffuser 1. Shown in FIG. 12 is a basic embodiment of a Helmholtz resonator 16 that comprises a rigid cylindrical container 17 surrounding a volume of air, and an orifice 18 in said rigid cylindrical container 17 that allows the surrounded volume of air to communicate with the ambient environment, said orifice 18 surrounding a volume of air equal to the area of the orifice 18 multiplied by the depth of the orifice 18. The rigid cylindrical container 17 may contain a quantity of acoustically lossy material in order to vary the absorption characteristic of Helmholtz resonator 16.

Figure 13:
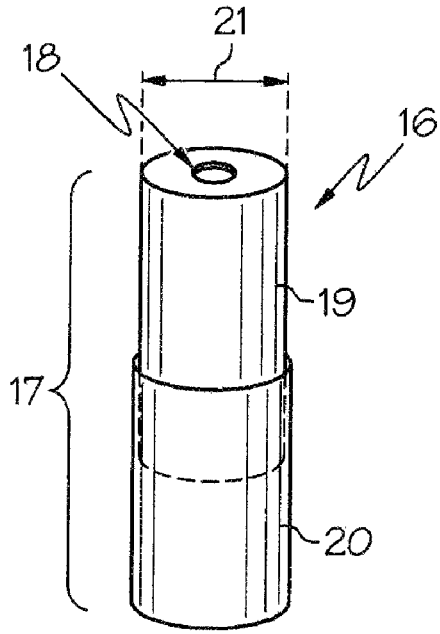
FIG. 13 is an elevated perspective view of a first embodiment of a Helmholtz resonator absorber with a cavity volume adjustment means.
Figure 14:
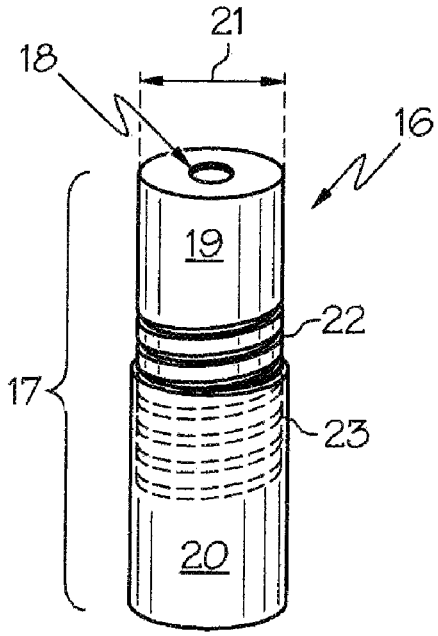
FIG. 14 is an elevated perspective view of a second embodiment of a Helmholtz resonator absorber with a cavity volume adjustment means.

FIG. 13 depicts a Helmholtz resonator 16 having a rigid cylindrical container 17 volume adjustment means in which the rigid cylindrical container 17 is made up of at least two pieces 19 and 20, where the outer diameter 21 of piece 19 is such that when the piece 19 is slid into piece 20, pieces 19 and 20 frictionally engage each other and so prevent their spontaneous separation, thus permitting continuous adjustment of the volume of the rigid cylindrical container 17 and therefore continuous adjustment of the center frequency of the absorption band of the Helmholtz resonator. The orifice 18 is depicted in FIG. 13 as appearing in piece 19, but could equally well appear in piece 20 instead of in piece 19. An alternative embodiment of a rigid cylindrical container 17 volume adjustment means is shown in FIG. 14, wherein the rigid cylindrical container 17 is made up of at least two pieces 19 and 20 that each have a threaded end 22 and 23 respectively, which threaded ends 22 and 23 threadably engage each other and so prevent the spontaneous separation of pieces 19 and 20, thus permitting continuous adjustment of the volume of rigid cylindrical container 17. In both rigid cylindrical container 17 embodiments shown in FIGS. 13 and 14, adjustment of the rigid cylindrical container 17 volume requires access only to one of the two ends of said rigid cylindrical container 17, and this in turn requires that the piece 19 or 20 that is not accessed be rigidly attached to the rear face 2 of the curved diffuser 1 such that when the accessed piece 19 or 20 is rotated into or out of the non-accessed piece 19 or 20, no movement is communicated to said non-accessed piece from said accessed piece. In both rigid cylindrical container 17 embodiments shown in FIGS. 13 and 14, the frictional engagement is achieved in a manner that permits at least two pieces 19 and 20 to be completely separated such that access can be gained to the interior of the rigid cylindrical container 17. The method of rigid attachment of Helmholtz resonator 16 to the rear face 2 of the curved diffuser 1 should ideally permit both easy release of said Helmholtz resonator 16 from said curved diffuser 1 and easy attachment of said Helmholtz resonator 16 to said curved diffuser 1. If said rigid attachment means is to be affixed to the curved diffuser 1 prior to the stacking of multiple curved diffusers 1, said rigid attachment means should be as thin as possible so as not to unduly impair the stacking of multiple curved diffusers 1; to this end, hook-and-loop fasteners are contemplated as attachment means, but other attachment means such as thin sheets of magnetic material or double-sided adhesive tape are possible provided that they meet the design criteria. In all embodiments of a rigid cylindrical container 17 volume adjustment means, further features may be used to enhance the operability of said rigid cylindrical container volume adjustment means such as detents at various points in the frictional engagement of rigid cylindrical container 17 pieces 19 and 20 that permit the creation of a repeatable rigid cylindrical container 17 volume, and a graphical indexing system that displays numerals or other symbols, each of which corresponds to a rigid cylindrical container 17 of a particular internal volume.

Figure 15:
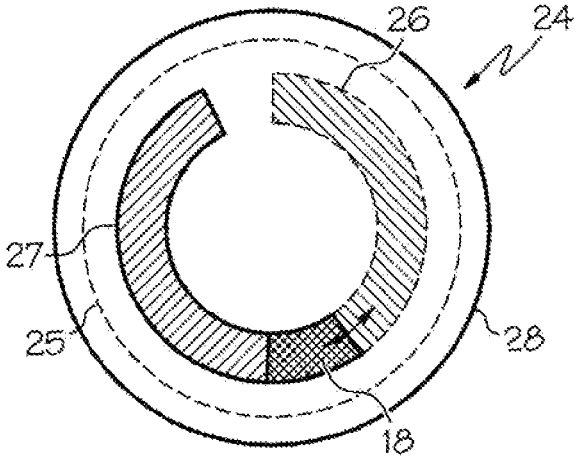
FIG. 15 is a plan view of a first embodiment of a Helmholtz resonator absorber orifice size adjustment means.
Figure 16:
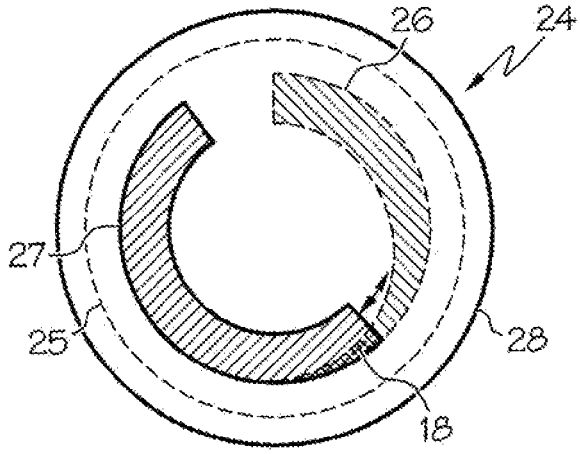
FIG. 16 is a plan view of a second embodiment of a Helmholtz resonator absorber orifice size adjustment means.
Figure 17:
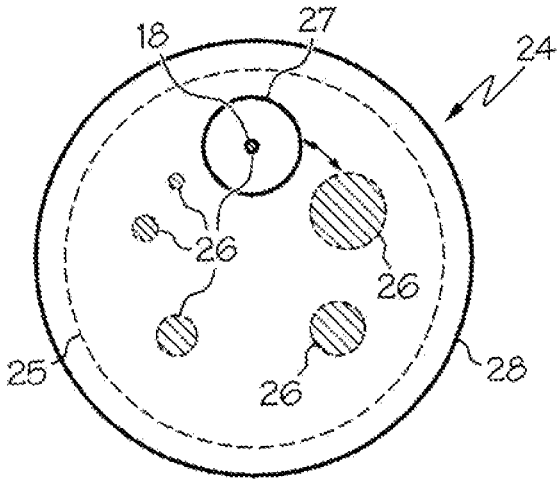
FIG. 17 is a plan view of a third embodiment of a Helmholtz resonator absorber orifice size adjustment means.

Shown in FIGS. 15 and 16 are two embodiments of an orifice size adjustment means 24, in which the adjustment means 24 is accessible from the end of the rigid cylindrical container 17 of the Helmholtz resonator 16. The orifice size adjustment means 24 can be fitted to either piece 19 or 20 forming the rigid cylindrical container 17. In FIG. 15 a simple embodiment of an orifice size adjustment means 24 is shown in which a flat circular base 25 contains a first opening 26 that is progressively covered or uncovered as a second opening 27 in a flat circular cover plate 28 is made to coincide with said first opening 26 by means of rotation of said flat circular cover plate 28 about its center, which center is coincident with the center of said flat circular base 25 which process creates an orifice 18. In FIG. 16 an embodiment of an orifice size adjustment means 24 is shown wherein the basic configuration is the same as that shown in FIG. 15, but where said first opening 26 and said second opening 27 are shaped as shown. Rotation of said flat circular cover plate 28 will now permit a finer adjustment of orifice size than will the embodiment shown in FIG. 15 as less area of said first opening 26 is covered or uncovered with an equal angle of rotation of said flat circular cover plate 28. In a further alternate embodiment shown in FIG. 17, said flat circular base 25 can contain a plurality of first openings 26, each of a different size, and said flat circular cover plate 28 can contain a single second opening 27 that is equal to or larger in size than the largest of said first openings 26. First openings 26 and second opening 27 would be arranged so that only one of said first openings 26 is uncovered at any one time as said flat circular cover plate 28 is rotated. In all embodiments of an orifice size adjustment means 24 further features may be used to enhance the operability of said orifice size adjustment means 24 such as detents at various points in the rotation of said flat circular cover plate 28 that permit the uncovering of an orifice 18 of a repeatable and defined area, and a graphical indexing system that displays numerals or other symbols, each of which corresponds to the uncovering of an orifice of a particular area.

In a preferred embodiment of the present invention, a nomogram, chart, or calculator is provided with the combination acoustic diffuser and absorber that details the relationships between the volume of rigid cylindrical container 17, the volume of orifice 18, the amount of acoustically lossy material in the rigid cylindrical container 17, the center frequency of sound absorption of the Helmholtz resonator 16, the magnitude of sound absorption at said center frequency, and the bandwidth of sound absorption.

While it will be apparent that the preferred embodiment described herein is well calculated to fulfill the objects above stated, it will be appreciated that the present invention is susceptible to modification, variation, and change without departing from the scope of the invention.

I claim:

1. A combination acoustical energy diffuser and absorber, comprising an acoustical energy diffuser made by a method comprising the vacuum forming of at least one sheet of pliable material in conformity with a shaped template and the subsequent fixing of the resulting shape of said material to produce an acoustically reflective surface having a front face and a rear face, wherein said acoustically reflective surface has a corrugated surface topology described by a plurality of alternating crests and wells, wherein the width of each individual well increases continuously from its minimum found at the bottom of the well to its maximum found at the top of the well, wherein the deepest points of all individual said wells are all coplanar with one another, wherein the depths of successive said wells of said corrugations relative to one another are in the same ratios as are those successive numbers determined through the calculation of a number theory sequence relative to one another, wherein said number theory sequence is a quadratic residue sequence, and further comprising at least one Helmholtz resonator acoustical energy absorber contained within a well on said rear face of said acoustically reflective surface and attached to said rear face of said acoustically reflective surface, said at least one Helmholtz resonator acoustical energy absorber comprising a cavity and at least one orifice allowing atmospheric communication between the interior of said cavity and the external environment, wherein at least one of said at least one Helmholtz resonator absorbers has an adjustable bandwidth.

2. The combination acoustical energy diffuser and absorber of claim 1 wherein the acoustical frequency absorption range of each of said Helmholtz resonator absorbers has an adjustable center frequency.

3. The combination acoustical energy diffuser and absorber of claim 2 wherein the center tuning frequency of the acoustical frequency absorption range of each of said Helmholtz resonator absorbers lies at a frequency that is substantially a positive integer multiple of 140 Hz.

4. The combination acoustical energy diffuser and absorber of claim 1 wherein the center tuning frequency of the acoustical frequency absorption range of each of said Helmholtz resonator absorbers lies substantially between 140 Hz and 560 Hz.

5. The combination acoustical energy diffuser and absorber of claim 4 wherein the center tuning frequency of the acoustical frequency absorption range of each of said Helmholtz resonator absorbers lies at a frequency that is substantially a positive integer multiple of 140 Hz.

6. A combination acoustical energy diffuser and absorber, comprising an acoustical energy diffuser made by a method comprising the vacuum forming of at least one sheet of pliable material in conformity with a shaped template and the subsequent fixing of the resulting shape of said material to produce an acoustically reflective surface having a front face and a rear face, wherein said acoustically reflective surface has a corrugated surface topology described by a plurality of alternating crests and wells, wherein the width of each individual well increases continuously from its minimum found at the bottom of the well to its maximum found at the top of the well, wherein the deepest points of all individual said wells are all coplanar with one another, wherein the depths of successive said wells of said corrugations relative to one another are in the same ratios as are those successive numbers determined through the calculation of a number theory sequence relative to one another, wherein said number theory sequence is a primitive root sequence, and further comprising at least one Helmholtz resonator acoustical energy absorber contained within a well on said rear face of said acoustically reflective surface and attached to said rear face of said acoustically reflective surface, said at least one Helmholtz resonator acoustical energy absorber comprising a cavity and at least one orifice allowing atmospheric communication between the interior of said cavity and the external environment, wherein at least one of said at least one Helmholtz resonator absorbers has an adjustable bandwidth.

7. The combination acoustical energy diffuser and absorber of claim 6 wherein the acoustical frequency absorption range of each of said Helmholtz resonator absorbers has an adjustable center frequency.

8. The combination acoustical energy diffuser and absorber of claim 7 wherein the center tuning frequency of the acoustical frequency absorption range of each of said Helmholtz resonator absorbers lies at a frequency that is substantially a positive integer multiple of 140 Hz.

9. The combination acoustical energy diffuser and absorber of claim 6 wherein the center tuning frequency of the acoustical frequency absorption range of each of said Helmholtz resonator absorbers lies substantially between 140 Hz and 560 Hz.

10. The combination acoustical energy diffuser and absorber of claim 9 wherein the center tuning frequency of the acoustical frequency absorption range of each of said Helmholtz resonator absorbers lies at a frequency that is substantially a positive integer multiple of 140 Hz.

* * * * *